United States Patent [19]

Hvizdos

[11] 4,202,678

[45] May 13, 1980

[54] AIR SEPARATION LIQUEFACTION PROCESS

[75] Inventor: Leonard J. Hvizdos, Emmaus, Pa.

[73] Assignee: Air Products & Chemicals, Inc., Allentown, Pa.

[21] Appl. No.: 620,963

[22] Filed: Oct. 9, 1975

[51] Int. Cl.[2] ..... F25T 3/00

[52] U.S. Cl. ..... 62/38

[58] Field of Search ..... 62/30, 38, 39

[56] References Cited

U.S. PATENT DOCUMENTS

| | | | |
|---|---|---|---|
| 2,873,583 | 2/1959 | Potts et al. | 62/38 |
| 3,034,306 | 5/1962 | Schuftan et al. | 62/30 |
| 3,210,948 | 10/1965 | Schilling | 62/38 |

*Primary Examiner*—Hiram H. Bernstein

*Attorney, Agent, or Firm*—Russell L. Brewer; Barry Moyerman

[57] ABSTRACT

This invention relates to a process for at least partially liquefying an air feedstream for subsequent separation into its components. The process comprises compressing an air feedstream, splitting the feedstream into at least a major portion, and a minor portion, partially cooling said major portion for delivery to a distillation or separation column, sufficiently cooling said minor portion for forming a critical fluid, isentropically expanding the thus formed critical fluid in a Pelton Wheel and then combining the minor portion and major portion for forming said air feedstream at a preselected pressure and temperature.

13 Claims, 4 Drawing Figures

AIR SEPARATION LIQUEFACTION PROCESS

BACKGROUND OF THE INVENTION

Typically in an air separation plant of the pumped or split cycle type wherein oxygen and nitrogen are generated as products, air is compressed to a pressure of about 100 psia or higher, divided into a major portion and a minor portion with the major portion being passed through reversing heat exchangers, whereby the air is at least sufficiently cooled for removing water and carbon dioxide and the minor portion, which supplies a substantial part of the required amount of cold product to balance the plant energy requirements, is compressed to a higher pressure usually from about 1200 to 3000 psia and cooled in a heat exchanger usually by the cold products obtained from the separation columns or by auxiliary refrigeration if the products are removed as liquids. If additional refrigeration is required for balancing the plant, it is generally provided by auxiliary refrigeration equipment, e.g. a Freon refrigeration unit. Other refrigeration from the minor portion can be obtained via a Joule-Thompson (isenthalpic) expansion or by work expansion (isentropic) or combination thereof prior to combining the minor portion with the major portion for forming a distillation feedstream.

It is, of course economically desirable to minimize the amount of energy required to compress the airstream and to minimize the amount of auxiliary refrigeration required to balance the refrigeration load air plant. This can be done by reducing the amount of the high pressure split or pumped portion which is compressed, cooled and expanded, and by making the refrigeration recovery process more efficient.

Cooling curves, i.e. a graph of the temperature-enthalpy relationships of the fluids to be cooled or warmed provide an indication of the efficiency of an air plant. As is known, the distance between the cooling curves is a measure of the driving force between the incoming airstream and the product stream, and is also a measure of the irreversibility of the process. As a general rule, the greater the distance between the curves the greater the energy input to achieve a balanced plant. When the cooling curves are close together, the more thermodynamically efficient the process. Hence, less energy but greater heat exchange surface is required in order to extract the refrigeration necessary to balance the plant. Thus, as the distance between the cooling curves increases, the cost of operation increases, and as the distance between the curves decreases, the capital cost increases.

In looking at cooling curves for plants producing high-pressure gases, e.g. above 600 psia, it is noted that the cooling curves tend to widen in the lower right-hand portion of the graph i.e. at a temperature below about −170° F. Thus, it would be advantageous to close in the cooling curves, usually beginning at about −170° F., in order to improve the thermodynamic efficiency of the plant.

Two approaches can be taken in closing the cooling curves in the lower right-hand portion of the graph, the first is by adding refrigeration at that point and the second is by removing a portion of the gas from the heat exchanger so that the remaining fluid can be cooled further. One of the basic problems with adding refrigeration at lower temperatures as shown in the lower right-hand portion of the graph is that the expense of such refrigeration is extremely high as compared to refrigeration which may be added in the upper left-hand portion. When one removes a portion of the incoming air stream midway in the heat exchanger, then there is less gas to be cooled by the product gases.

Some other problems associated with closing in of cooling curves, particularly those in air plants where liquefied oxygen and high pressure gases e.g. at pressures above 600 psig, are produced will become apparent in the description of the prior art.

DESCRIPTION OF THE PRIOR ART

A process comprising isenthalpic and isentropic expansion as a means of closing in the cooling curves for an air separation plant is shown in U.S. Pat. No. 3,285,028. This process for providing enhanced refrigeration in an air plant comprises adiabatically expanding air after it has been cooled in a first heat exchanger, isentropically expanding a side stream of air after it has passed through a second heat exchanger and then, recovering the refrigeration from the work expanded air in the first heat exchanger. In this process, though, the air is isentropically expanded prior to being converted to a critical fluid i.e. at a temperature of about −50° F. rather than at substantially lower temperatures. Thus, the amount of sidestream for work expansion is extremely limited in order to prevent pinching of the cooling curves at lower temperatures e.g. at −150° F. to −170° F. Further, removal of the sidestream at this point does not substantially close in the cooling curves in the lower righthand portion e.g. below −170° F.

In U.S. Pat. No. 3,141,751, there is shown an improved process for purifying compressed gas mixtures by the removal of water and carbon dioxide prior to separation. In such a process, a sidestream of gas from reversing heat exchangers is work expanded for obtaining lower temperature refrigeration and balancing the heat load in the reversible heat exchange zone. The conditions in the process are selected such that only a minimum amount of gas is passed through the expander with the inlet temperature selected to operate as cold as possible without generating liquid condensation in turbine discharge. Although this process is advantageous for balancing the heat load in the reversing heat exchangers, it has little applicability here in that the improvement does not relate to closing in the cooling curves in the lower right-hand portion cooling curves.

In U.S.Pat. No. 3,203,191 there is shown a process for enhancing a liquefaction of gases by expanding gases through a Pelton Wheel. In this particular process, the conditions are controlled such that the back pressure on the Pelton Wheel is maintained in excess of the saturation pressure of the liquid. Thus, in this type of operation the Pelton Wheel inherently is operating in a liquid medium and the efficiency of such operation is substantially reduced as compared to the efficiency of a Pelton Wheel operating in a vapor environment.

SUMMARY OF THE INVENTION

Broadly, this invention relates to an improvement in a refrigeration process for producing an air feedstream for separation into its components wherein an air feedstream is compressed, split into at least a major portion and a minor portion with the major portion being at least partially cooled for removing carbon dioxide and water, the minor portion being partially cooled for removing carbon dioxide and water and then sufficiently cooled so that when it is combined with said major portion an air feedstream at a preselected temperature and pressure is formed. The improvement comprises:

compressing said minor portion to a pressure above the critical pressure, if the gas is below the critical pressure, cooling said minor portion to a temperature at least below the critical temperature thereby forming a critical fluid, isentropically expanding the thus formed critical fluid in a Pelton Wheel, preferably under conditions such that the liquefied air is withdrawn from the Pelton Wheel at its saturation temperature or at a temperature below its saturation temperature, said Pelton Wheel being operated in a vapor environment which is established and maintained by the method selected from the group consisting of injecting a second gas into the Pelton Wheel at the saturation temperature, or at a temperature slightly above the saturation temperature, and raising the enthalpy of the liquefied air to an enthalpy above the enthalpy of the saturation liquid, and combining said expanded minor portion and said major portion thereby forming said air stream at said preselected temperature and pressure.

In a second embodiment as shown in FIG. 1, the minor portion is isentropically expanded to a first pressure and then isenthalpically expanded to preselected pressure.

In a third embodiment as shown in FIG. 3, said minor fraction is cooled to a temperature below about −170° F. but higher than the temperature at which the deviation between the cooling curve and warming curve exceeds about 10° F., split into a first and second fraction, said first fraction being isenthalpically expanded to said preselected pressure, said second fraction then being further cooled to a temperature below its critical temperature and then isentropically expanded as described.

By carrying out the refrigeration process of this invention, including isentropically expanding air after it has passed through a main heat exchange zone and converted into a critical fluid, several advantages can be achieved. These advantages include:

the ability to eliminate external refrigeration, e.g. Freon units, in balancing the plant for producing liquefied products as work is recovered from a substantial portion of the highly compressed air stream;

the ability to produce high-pressure gases, e.g. above about 600 psig to 3000 psia or liquefied gases in a thermodynamically efficient operation;

the ability to reduce the amount of air to the high pressure side of the air plant thereby reducing compressor power requirements;

the ability to use of simple equipment for obtaining work from liquid which can replace the more expensive auxiliary refrigeration equipment, e.g. Freon refrigeration equipment.

THE DRAWINGS

DESCRIPTION OF THE PREFERRED EMBODIMENTS

Figure 1:
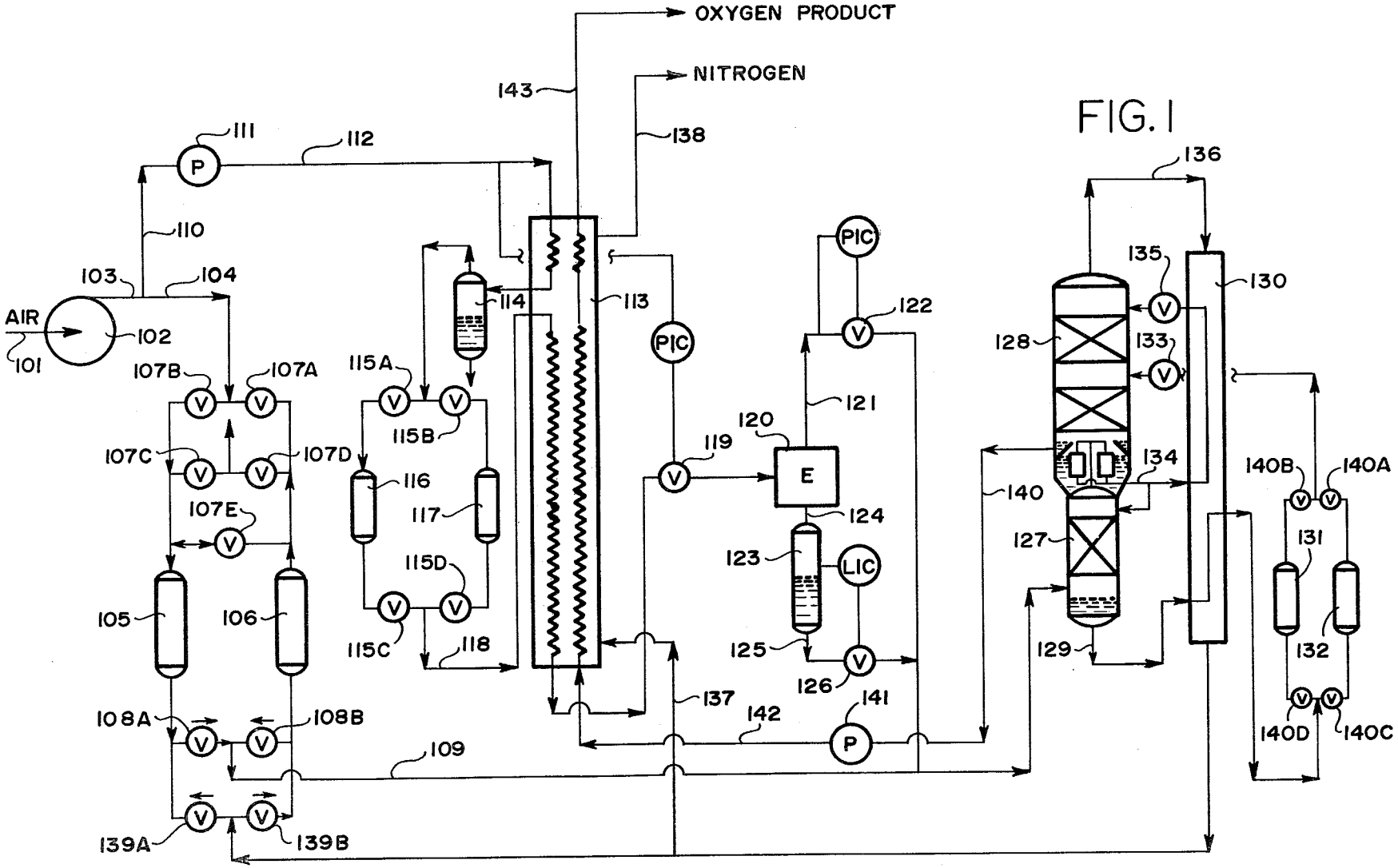
FIG. 1 is a schematic diagram of an air separation plant, including an isentropic and isenthalpic expansion according to the present invention.
Figure 3:
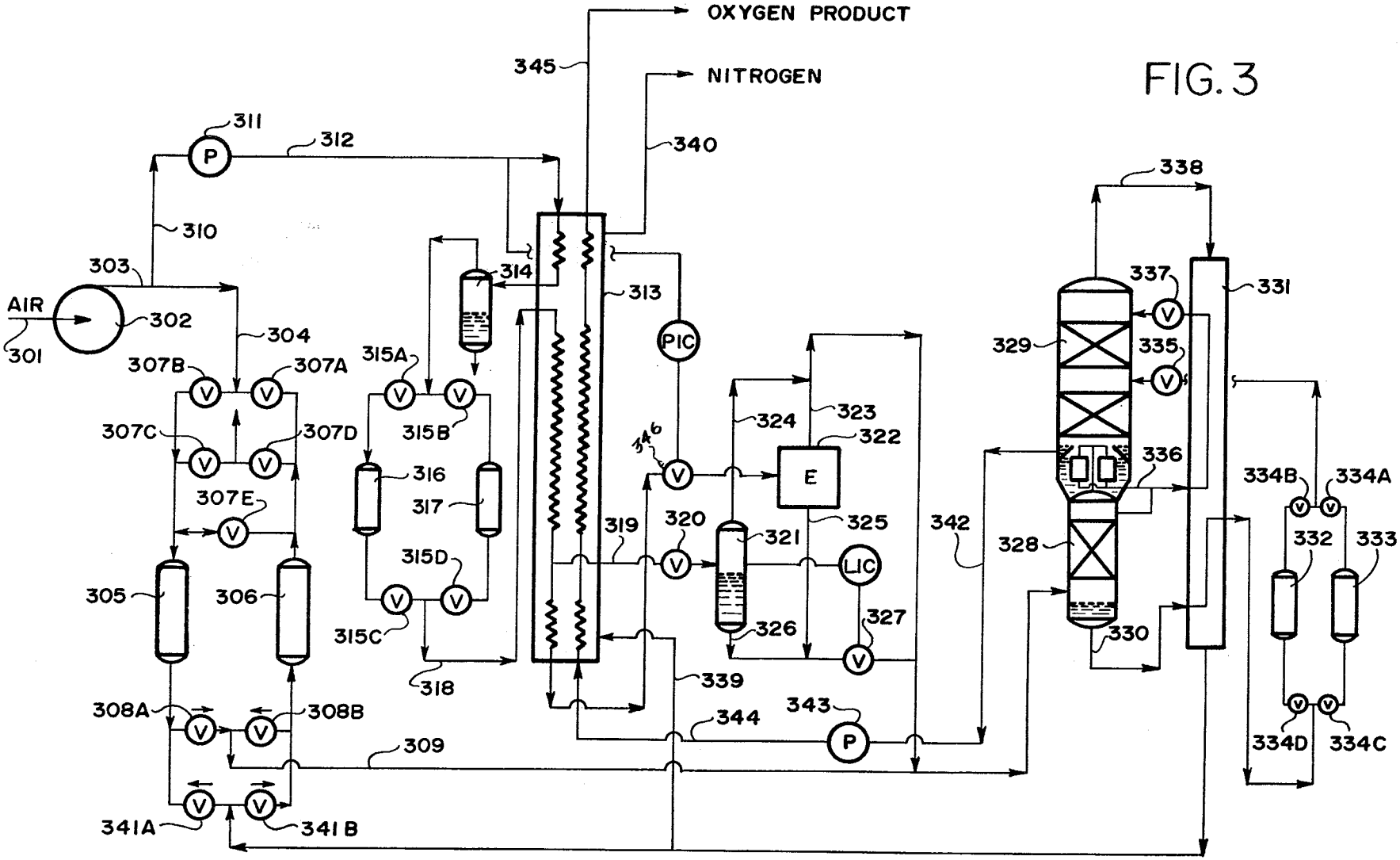
FIG. 3 is a schematic diagram of a pumped oxygen cycle separation plant including an isenthalpic and isentropic expansion for the minor portion.

Referring to FIGS. 1 and 3, which is a schematic view of an air plant, it will be noted that the left-hand to central portion generally describes the refrigeration cycle for producing an air feedstream at a preselected temperature and pressure for separation into its components through conventional distillation and separation apparatus shown in the right-hand portion. The calculations are based on one mole of dry air feedstream introduced to the plant at 90 psia and 100° F. and a product comprising oxygen at 98° F. and a pressure of about 1565 psia and nitrogen at 15 psia and a temperature of 98° F.

In referring to FIG. 1, 27,077 moles per hour of air is passed through inlet 101 to compressor 102 and compressed to a pressure of about 90 psia for delivery to a pumped oxygen cycle air plant. Compressor 102 requirements are 31,098 BHP. The temperature of the air at this point is approximately 100° F. by virtue of air or water cooling after compression. The air is exhausted from compressor 102 to line 103 and split into a major fraction and a minor fraction. A major portion or 0.72 moles/mole feed is passed through line 104 to regenerators or reversing heat exchangers 105 and 106 of the regenerative type by appropriate control of valves 107A, 107B, 107C, 107D, and 107E. The air is cooled in regenerators 105 and 106 e.g. to a temperature of about −275° F. (typically between −270° F. and −280° F.) where carbon dioxide and water are deposited on stones and subsequently removed during regeneration. By appropriate control of valves 108A and 108B the air is removed via line 109 from regenerators 105 and 106 for distribution to the separation apparatus of the plant.

A minor portion, 7581 moles/hr or 0.28 moles air/mole feed, is conveyed through line 110 to compressor 111 and exhausted from compressor 111 at a pressure of about 1950 psia and a temperature of 100° F. through line 112. Compressor 111 requirements are 16,975 BHP. This high pressure gas is passed to coil wound heat exchanger 113 where it is initially cooled to a temperature of about 40° F. for condensing part of the water from the air. The water is removed in phase separator 114 and by appropriate control of valves 115A, 115B, 115C and 115D passed to absorbers 116 and 117 for removal of the remaining water and carbon dioxide. Generally a molecular sieve or other desiccant is present in absorbers 116 and 117. The air stream having the water and carbon dioxide removed is passed through line 118 back to coil wound heat exchanger 113 and cooled to a temperature of −250° F. Generally the minor portion is cooled to a temperature of from about −240° F. to about −260° F. for this type of operation.

Figure 2:
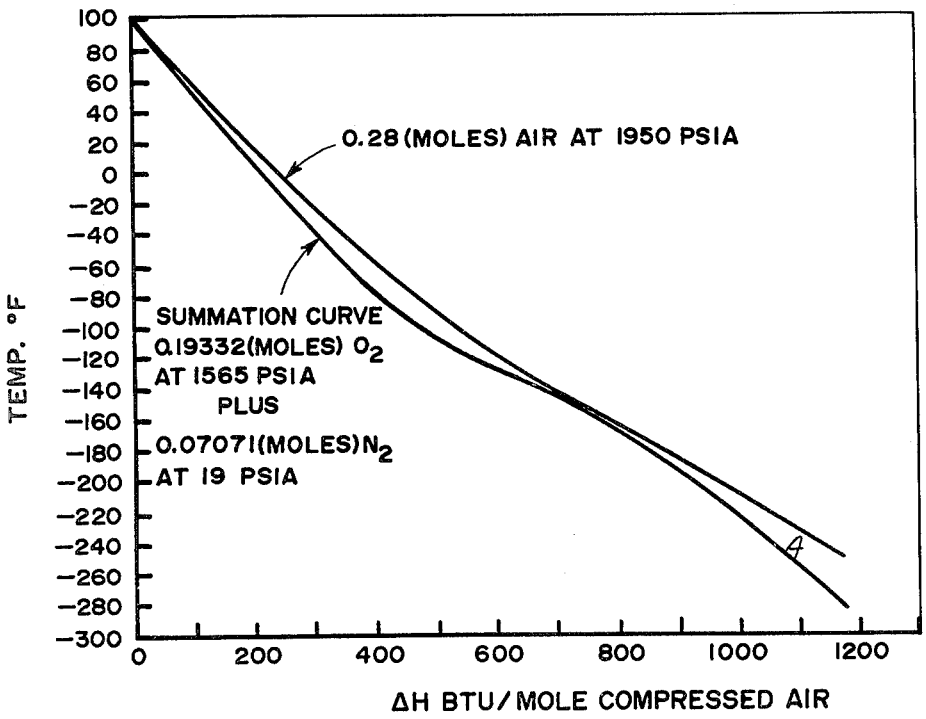
FIG. 2 is a graphical presentation of the temperature-enthalphy relationship regarding the cooling of the minor portion and the warming of product gases i.e. $N_2$ and $O_2$ represented as a single sum with the temperature in degrees Fahrenheit plotted on the ordinate and the change in enthalpy per mole of compressed air on the abscissa for the plant of FIG. 1.

This process is unlike that described in FIG. 3 in that greater thermodynamic efficiency, although minimal, is not achieved in the heat exchanger as the cooling curve at the lower right-hand portion (designated area A) is not closed in (within 5° F.) as shown in FIG. 2. However, if greater thermodynamic efficiency with respect to this particular cooling curve is desired, the process as described in the plant of FIG. 3 could be utilized. On the other hand, the process of FIG. 1 is not as complex in that the heat exchanger is not as complicated.

Continuing with FIG. 1, the air at −250° F. is removed from heat exchanger 113 through continuation of line 118 through pressure indicator control valve 119 and passed to Pelton Wheel expander 120. Pressure control valve 119 maintains the appropriate pressure of the minor portion in line 112. A variable size controlled nozzle into the Pelton Wheel may serve the same function as pressure indicator control valve 119.

Expander 120 is a Pelton Wheel expander of the type described in commonly assigned, copending application having U.S. Ser. No. 607,226, a filing date of Aug. 5, 1975 and entitled "Isentropic Expansion of Gases via a Pelton Wheel." The description and operation of the Pelton Wheel in that application is incorporated by reference. Basically, though, the high-pressure, cold air at −250° F. and 1900 psia is isentropically or work expanded in expander 120 to about 190 psia under conditions such that liquid droplets fall from the Pelton Wheel through line 124 forming a liquid level in phase separator 123 located below expander 120. The liquid droplets as they drop from the Pelton Wheel are at or below the saturation temperature of the liquid at that pressure. Work by means of a compressor, generator, or other device (not shown) is removed during expansion and this work usually is utilized to offset some of the energy requirements of the plant e.g. for compressing the air to high-pressure. The maximum theoretical amount of work ($W=\Delta H$) that can be recovered by this expansion for reducing the net power requirement by the plant is about 205 BTU/lb mole or about 458 BHP at 75% efficiency. Pelton Wheel efficiencies greater than 75% are possible, but for present calculations, 75% is used.

It is possible to absorb all of the pressure drop in the Pelton Wheel expander provided that the gas is cooled sufficiently e.g. to −275° F. so that at the end of the expansion the droplets are at the saturation temperature or slightly below. At −250° F., expansion to 90 psia may result in the formation of a substantial amount of vapor in the nozzle and this may have adverse effects on the efficiency of the engine or on the life of the engine. Thus, the remaining expansion is effected through a conventional Joule-Thompson or similar valve to the preselected pressure. Because the entropy lines are substantially vertical at this portion of a pressure-enthalpy graph very little work could be recovered from the expansion from 190 psia to 90 psia anyway and thus the efficiency of the process is not adversely affected.

A vapor environment is maintained in Pelton Wheel expander 120 in order to improve the efficiency of the Pelton Wheel for doing work. The vapor is withdrawn through line 121. A vapor is maintained in expander 120 by controlling the expansion pressure via pressure indicator control valve 119 to a point where the liquid droplets, as they fall from the Pelton Wheel, are substantially at the saturation temperature or slightly below e.g. 1°-5° C. Due to inefficiencies e.g. in the form of heat leaks or friction losses which raises the enthalpy of the droplets, the liquid droplets are converted into a small fraction of vapor which is sufficient for maintaining the Pelton Wheel in a vapor environment. If the pressure maintained by the pressure indicator control valve 119 is in excess of the saturation temperature of the liquid then liquid in phase separator 123 will rise through line 124 and fill the Pelton Wheel expander 120. If the pressure is too low, then a substantial amount of vapor may be formed in the nozzle and may effect engine efficiency and life as noted previously.

The liquid (0.278 moles/mole feed) at a temperature of −260° F. in Pelton Wheel expander 120 is removed by line 124 and passed to phase separator 123. Liquid is withdrawn through line 125 from the bottom of phase separator 123, reduced in pressure to 88 psia through liquid indicator throttle valve 126, and then joined with vapor line 121 and then with distillation feed line 109. Throttle valve 126 not only maintains an appropriate liquid level in phase separator 123, but also effects an isenthalpic expansion to the preselected pressure and cooling to about −282° F.

In the right-hand portion of FIG. 1 there is shown a conventional schematic design for the separation of air into its components with the appropriate lines back to the refrigeration cycle for recovering refrigeration from the products. Briefly, distillation feed in line 109, which is at a pressure of about 88 psia and a temperature of about −279° F., is introduced into high-pressure distillation column 127 followed by further distillation in low-pressure column 128. A crude liquid oxygen product is withdrawn from the bottom of high pressure column 127 through line 129, cooled in heat exchanger 130 and then passed through regenerating absorbers 131 and 132 for removing hydrocarbons and other impurities. Flow through absorbers 131 and 132 is controlled by valves 140A, 140B, 140C and 140D. The crude liquid oxygen then is isenthalpically expanded across throttle valve 133 into low-pressure column 128. Liquid nitrogen is withdrawn from high-pressure column 127 and low pressure column 128 through line 134, passed through heat exchanger 130 for cooling against product nitrogen gas, then isenthalpically expanded through throttle valve 135 and sent to the top of low-pressure column 128.

Low-pressure nitrogen at 20 psia (0.777 moles/mole feed) is removed from the top of low-pressure column 128 through line 136 and warmed in heat exchanger 130, against crude liquid oxygen and liquid nitrogen from high pressure column 127, withdrawn at a temperature of −285° F. and directed back to the refrigeration portion of the plant through line 136 for recovering refrigeration from the nitrogen. About 0.07071 moles/mole feed of the nitrogen from line 136 is introduced into the shell side of heat exchanger 113 through line 137 and withdrawn at a temperature of about 98° F. and a pressure of 15 psia through line 138. The remaining portion of the cold nitrogen in line 136 is sent to regenerators 105 and 106 by controlling valves 139A and 139B to cool the major portion to −275° F. The nitrogen is withdrawn at a pressure of 15 psia and a temperature of 95.8° F. by controlling valves 107C, 107D and 107D.

Low-pressure oxygen (0.193 moles/mole feed) at about −290° F. and 22 psia is withdrawn from low-pressure column 128 via line 140 and compressed in pump 141 to a pressure of about 1600 psia. The temperature of the oxygen leaving pump 140 is about −281° F. Based on pump efficiency calculations, it is estimated that 38.9 BTU/ mole of air or 330 KW are added to the system. The high-pressure oxygen exits pump 140 through exit line 142 and is passed through bundles or coils in heat exchanger 113 for recovering refrigeration therefrom. About 0.193 moles oxygen/mole feed at about 98° F. and pressure of 1565 psia is withdrawn through line 143.

In referring to FIG. 2 which represents the cooling and warming curve for the plant of FIG. 1 with the cooling curve representing the minor portion or 0.28 moles air per mole feed at 1950 psia and the warming curve which represents the sum of 0.19332 moles oxygen at 1565 psia and 0.07071 moles nitrogen at 19 psia per mole of feed, it is noted that the amount of air required on the high pressure side of the plant is very small as compared to conventional cycles. Further, the cooling curve for the minor portion is very close to the warming curve which shows that there is excellent thermodynamic efficiency in the process. Greater thermodynamic efficiency could be achieved at the lower right-hand portion of the cooling curve (Area A) if a sidestream were removed at about −200° F. as the cooling curve widens substantially e.g. more than 10° F. at about this point to the final cooling temperature of about −250° F. and expanded. This will be discussed with the description of Plant of FIG. 3.

In the refrigeration cycle for the plant of FIG. 3, 27,043 lb moles/hour air is introduced through inlet 301 to compressor 302 and compressed to 90 psia. After cooling against air or water to 100° F. is exhausted through line 303. Compressor 302 requirements are about 31,059 BHP. Based on a feedstream of one mole of dry air, assuming water and carbon dioxide have been extracted, the exit stream is split into a major portion and a minor portion. The major portion or 0.69 moles/mole feed is passed through line 304 to reversing heat exchangers 305 and 306 of the regenerative type. Only air or nitrogen is flowing in each regenerator and the operation is controlled by the use of valves 307A, 307B, 307C, 307D and 307E. Because the regenerator is cold, the warm major portion is cooled sufficiently for removing water and carbon dioxide. About 0.662 moles/mole feed leaves the bottom of reversing heat exchangers 305 and 306 at −275° F. by appropriate control of valves 308A and 308B and are passed to distillation feed line 309.

A minor portion or roughly 0.31 moles air/mole feed or 8383 moles/hr is passed through line 310 to compressor 311 and compressed to a pressure of about 1950 psia. It is cooled to a temperature of 100° F. thus forming the high-pressure side of the refrigeration cycle. Compressor 311 requirements are about 18,771 BHP. The high-pressure air from compressor 311 is passed through exit line 312 into coil wound heat exchanger 313. The air is initially cooled to a temperature of about 40° F. The minor portion is removed from heat exchanger 313 and passed to separator 314 for removing condensed water and then by appropriate control of valves 315A, 315B, 315C and 315D to adsorbers 316 and 317. Adsorbers 316 and 317 contain a molecular sieve or some other desiccant for removing carbon dioxide and water.

Figure 4:
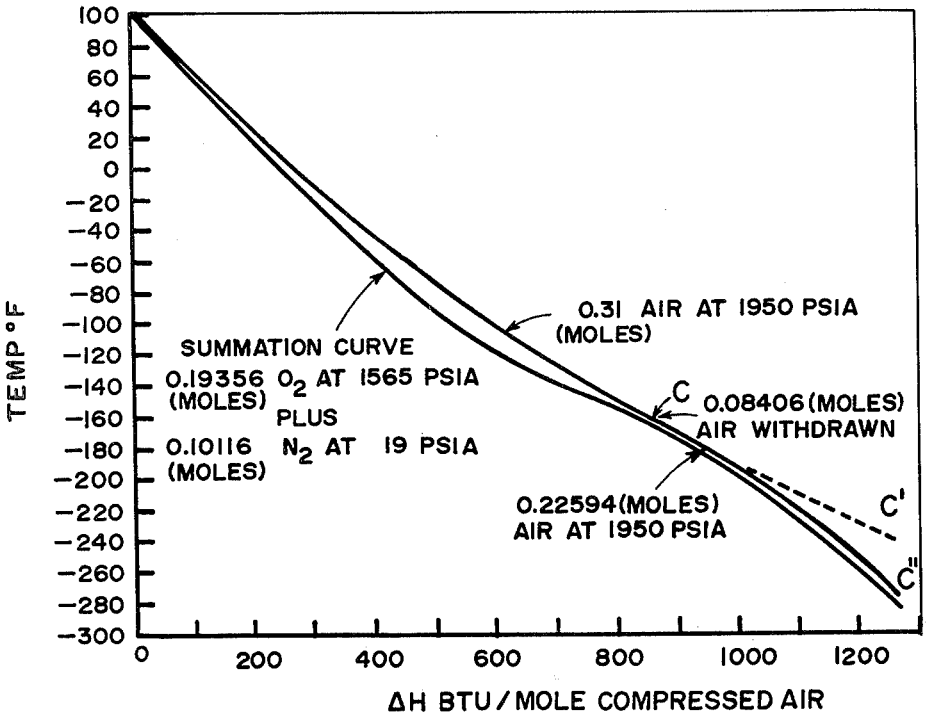
FIG. 4 is a graphical presentation of the temperature-enthalpy relationship regarding the cooling of the minor portion and the warming of product gases i.e. $N_2$ and $O_2$ represented as a single sum with temperature in degrees Fahrenheit plotted on the ordinate and the change in enthalpy per mole of compressed air on the abscissa for the plant of FIG. 3.

The minor portion of air is introduced back into heat exchanger 313 through line 318 and further cooled to a temperature of about −160° F. At this point, (Point C in FIG. 4) a first fraction or 0.08406 moles of air/mole feed is withdrawn from heat exchanger 313 through line 319 and isenthalpically expanded in throttle valve 320 to a pressure of about 90 psia and discharged to phase separator 321. Point C on the cooling curve is chosen as the point to withdraw a sidestream as the cooling curve begins to widen substantially from the warming curve at this point with continued widening through the complete cooling cycle if not removed as shown by line C-C'. The withdrawing of a sidestream of this quantity i.e. 0.08406 moles/mole feed from heat exchanger 313 at point C causes the cooling curve to close (within about 5° F.) thereby making the cooling process for the remaining 0.22594 moles/mole feed more thermodynamically efficient as shown by line C-C''.

Although the temperature for withdrawal of a sidestream in this embodiment is about −160° F. to −170° F., it may vary. For example, the point may be at about −200° F. as noted in FIG. 2. Generally the withdrawal point will be between about −160° F. to about −220° F. although this will depend on the amount of gas on the high side and the pressure and temperature of the products. The most efficient plan though is to withdraw a side stream at the point where the cooling curve begins to widen at a temperature below about −160° F. and withdraw only that amount necessary to close in the cooling curve within 10° and preferably 5° through the remaining cooling cycle. This aids in making the heat exchanger operation more thermodynamically efficient.

The second fraction or 0.2259 moles of air/mole feed remains in coil wound heat exchanger 313 is further cooled to −275° F. thereby being converted to a critical fluid. By that, the gas is at a pressure above its critical pressure, i.e., in this case 1950 psia and the temperature is below the critical temperature i.e. −275° F. The gas, which is now a critical fluid, is passed through continuation of line 318 and pressure indicator control valve 346 to Pelton Wheel expander 322 for isentropic expansion to 88 psia. In this process all of the expansion to the preselected pressure is effected in Pelton Wheel expander 322.

A vapor environment is maintained in expander 322 in order to improve the efficiency of expansion and this is effected by allowing vapor access through line 323 from vapor line 324 from phase separator 321. If the liquid droplets in Pelton Wheel expander 322 are subcooled, i.e. below the saturation temperature, then vapor is pulled into the Pelton Wheel expander 322 through vapor line 323 and condensed. On the other hand, if the pressure is such that the liquid droplets are at the saturation temperature and the enthalpy of the liquid layer below Pelton Wheel expander 322 is raised to the saturation temperature or slightly above by virtue of heat leaks and friction losses as in the case of FIG. 1, then vapor is generated and it is withdrawn through vapor line 323 joined with vapor line 324 and directed to distillation feed line 309. The liquid droplets in Pelton Wheel expander 322 drop through line 325 and are combined with liquid which is withdrawn through line 326 from phase separator 321. This resulting liquid passes through liquid indicator control valve 327 and joined with vapor line 323 and directed to distillation feed line 309 thereby forming a distillation feedstream at a preselected temperature and pressure.

In this process, about 200 BTU's per lb mole of feed is available on isentropic expansion. Because the second fraction is at a lower temperature than the minor portion for the plant of FIG. 1, all of the expansion can take place in the Pelton Wheel. It is not necessary to expand to a first pressure and then isenthalpically expand to the preselected pressure. With 200 BTU's per lb mole of feed available on complete expansion, 360 BHP is recovered. This horsepower is less than the plant shown in FIG. 1 because the second fraction is smaller than the minor portion of the plant in FIG. 1.

In the right-hand portion of FIG. 3 there is shown a conventional schematic design for the separation of air into its components with the appropriate lines back to the refrigeration cycle for recovering refrigeration from the products. Briefly, the distillation feed, which is at a pressure of about 90 psia and a temperature of about −279° F. is introduced into high-pressure column 328 for separation into its components followed by distillation in low-pressure column 329. A crude liquid oxygen product from the bottom of high pressure column 327 is withdrawn through line 330 and passed through heat exchanger 331. The cooled product then is passed through regenerating adsorbers 332 and 333 via control of valves 334A, 334B, 334C, and 334D for removing hydrocarbons and other impurities. The crude liquid oxygen then is flashed across throttle valve 335 into low-pressure column 329. Liquid nitrogen is withdrawn from high-pressure column 328 through line 336, passed through heat exchanger 331 for cooling against product nitrogen gas, then isenthalpically expanded through throttle valve 337 and sent to the top of low-pressure column 329.

Low-pressure nitrogen (0.7788 moles/mole feed) at 20 psia is removed from the top of low-pressure column 329 through line 338 and warmed in heat exchanger 331, withdrawn at a temperature of about −285° F. and directed back to the refrigeration portion of the plant via the continuation of line 338 for recovering refrigeration from the nitrogen. About 0.101 moles of the nitrogen from line 338 is introduced into the shell side of heat exchanger 313 through line 339 and withdrawn at a temperature of about 98° F. and a pressure of 15 psia through line 340. The remaining portion or 0.677 moles of cold nitrogen in line 336 is sent to regenerators 305 and 306 by control of valves 341A and 341B in order to effect cool-down and withdrawn at a pressure of 15 psia and a temperature of 95.8° F. via valves 307C, 307D, and 307E.

Low-pressure oxygen at about −290° F. and 22 psia is withdrawn from low-pressure column 329 via line 342 and compressed in pump 343 to a pressure of about 1600 psia. The temperature of the oxygen leaving pump 343 is about −281° F. The high-pressure oxygen exits pump 343 through exit line 344 and is passed through bundles or coils in heat exchanger 313 for recovering refrigeration therefrom. Oxygen (0.193 moles) at about 98° F. and pressure of 1565 psia is withdrawn through line 345.

In comparing the net power requirements for operating the plants described in FIGS. 1 and 3 in terms of conventional air cycles of the split or pumped type, the following power requirement ratios are noted. The embodiment described in FIG. 1 requires the least amount of power to produce the same amount of products at the pressures and temperatures defined. The process as described in FIG. 3 requires 1.04 times the power requirement of the plant of FIG. 1. Conventional cycles, i.e. those using Freon units and coupled with isenthalpic expansions etc. on the other hand, require at least 1.05 times the power requirement plant of FIG. 1. Thus it is clearly shown that the processes described in FIG. 1 and in FIG. 3 are clearly superior to the conventional cycles using isentropic or a combination of an isentropic-isenthalpic expansion to produce cryogenic products.

A slight improvement can be made in the plants described in FIGS. 1 and 3, particularly plant 3, if the sidestream or the first fraction removed from the main heat exchanger is isentropically expanded to a first pressure and then isenthalpically expanded to the preselected pressure. For example, if this technique was used in the plant of FIG. 1 to close in the cooling curves thereby decreasing the area designated A, sidestream could be removed at about −200° F. and isentropically expanded to a pressure of about 450 psia and then isenthalpically expanded to the preselected pressure. This would permit the recovery of some work which ordinarily would be lost by isenthalpic expansion to the preselected pressure. This approach will reduce the power requirements even for the plant shown on FIG. 1. However, because of the complexity of operating two (2) expanders and complexity in equipment design, the capital costs for the equipment may negate any advantages that might be achieved by reduction in power requirement.

What is claimed is:

1. A process for at least partially liquefying an air feed stream for delivery to a distillation column at a preselected temperature and pressure for separation into its components which comprises:

compressing an air feedstream, splitting the air feedstream into at least a major portion and a minor portion with the major portion being at least partially cooled, compressing said minor portion to a pressure above the critical pressure, if the minor portion is below the critical pressure, cooling said compressed minor portion to a temperature below the critical temperature until said minor portion is converted into a critical fluid, isentropically expanding said critical fluid in a Pelton Wheel under conditions such that the liquefied air is withdrawn from the Pelton Wheel at its saturation temperature or at a temperature below its saturation temperature, said Pelton Wheel being operated in a vapor environment established and maintained by the method selected from the group consisting of injecting a second gas into the Pelton Wheel at the saturation temperature, or at a temperature slightly above the saturation temperature, raising the enthalpy of the liquefied air to an enthalpy above the enthalpy of the saturated liquid, and combining said major portion and said minor portion for forming an air feedstream at said preselected pressure and temperature.

2. The process of claim 1 wherein said vapor environment is established and maintained by raising the enthalpy of the liquefied air to an enthalpy above the enthalpy of the saturated product.

3. The process of claim 2 wherein said minor portion is compressed to a pressure of from about 550 psia–3000 psia.

4. The process of claim 3 wherein said minor portion is cooled to from −240° F. to −260° F. prior to effecting said isentropic expansion.

5. The process of claim 4 wherein said minor portion is isentropically expanded to a first pressure, and then isenthalpically expanded to said preselected pressure.

6. A process for at least partially liquefying an air feedstream for delivery to a distillation column at a preselected temperature and pressure for separation into its components which comprises:

compressing an air feedstream, splitting the air feedstream into at least a major portion and a minor portion with the major portion being at least partially cooled, compressing said minor portion to a pressure above the critical pressure, if the minor portion is below the critical pressure, cooling said compressed minor portion in indirect heat exchange with a cooling fluid to a temperature below −160° F. but not below the temperature where the temperature of the minor portion is greater than about 10° F. than that of the cooling fluid, splitting said minor portion at such temperature point into at least a first and second fraction with said first fraction being adiabatically expanded;

further cooling said second fraction to a temperature below the critical temperature until said second fraction is converted into a critical fluid, isentropically expanding said critical fluid in a Pelton Wheel under conditions such that the liquefied air is withdrawn from the Pelton Wheel at its saturation temperature, or at a temperature below its saturation temperature, said Pelton Wheel being operated in a vapor environment which is established and maintained by the method selected from the group consisting of injecting a second gas into the Pelton Wheel at the saturation temperature, and raising the enthalpy of the liquefied air to an enthalpy above the enthalpy of the saturated liquid, and combining said expanded first fraction, said second fraction and said minor portion for forming an air feedstream at said preselected pressure and temperature.

7. The process of claim 6 wherein said vapor environment is established and maintained by raising the enthalpy of the liquefied air to an enthalpy above the enthalpy of the saturated liquid.

8. The process of claim 7 wherein said minor portion is compressed to a pressure of from about 550 to 3000 psia.

9. The process of claim 8 wherein said minor portion is cooled to from −160° F. to −280° F. prior to withdrawing said first fraction.

10. The process of claim 9 wherein said second fraction is cooled to about −260° F. to about −280° F. prior to effecting isentropic expansion.

11. The process of claim 10 wherein said first fraction is isenthalpically expanded to about said preselected pressure.

12. The process of claim 11 wherein said second fraction is isentropically expanded to about said preselected pressure.

13. The process of claim 11 wherein said second fraction is isentropically expanded to a first pressure and then isenthalpically expanded to said preselected pressure.

* * * * *